US006257040B1

(12) United States Patent
Baensch et al.

(10) Patent No.: US 6,257,040 B1
(45) Date of Patent: Jul. 10, 2001

(54) METHOD FOR CONTROLLING A HYDRAULIC ROTARY AND FEED DRIVE FOR A COLD PILGER ROLLING MILL

(75) Inventors: Michael Baensch, Mönchengladbach; Wolfgang Ernhardt, Wermelskirchen; Bernhard Gromada, Remscheid; Ernst Höller, Remscheid; Horst Mattes, Remscheid, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/471,870

(22) Filed: Dec. 23, 1999

(30) Foreign Application Priority Data

Dec. 23, 1998 (DE) ..... 198 60 710

(51) Int. Cl.[7] ..... B21D 7/02
(52) U.S. Cl. ..... 72/214
(58) Field of Search ..... 72/7.1, 8.2, 10.1, 72/10.4, 214, 249

(56) References Cited

U.S. PATENT DOCUMENTS 4,037,444 * 7/1977 Ledebur et al. ..... 72/214
4,562,713 * 1/1986 Kondoh ..... 72/214
5,419,173 * 5/1995 Baensch et al. ..... 72/214
5,921,128 * 7/1999 Stinnertz et al. ..... 72/214

* cited by examiner

*Primary Examiner*—Rodney A. Butler
(74) *Attorney, Agent, or Firm*—Cohen, Pontani, Lieberman & Pavane

(57) ABSTRACT

The invention relates to a method for controlling a hydraulic rotary and feed drive for a cold pilger rolling mill for producing rolling stock, the cold pilger mill having a rolling stand that moves back and forth in the rolling direction by a crank drive so that rolls of the roll stand, which are of tapering design, roll over the rolling stock with an alternating sense of rotation. The roll stand intermittently releases the rolling stock so that the rolling stock may be rotated and fed by the hydraulic rotary and feed drive to a new position as a function of the position of the crankshaft of the roll stand. The rotation and feeding of the tube are performed by hydraulic motors controlled by pressure medium and assigned to the drive members acting on the tube. The pressure medium feed of each hydraulic motor is controlled by a proportional valve which is opened for a time interval proportional to a path required for the drive member moved by this hydraulic motor.

2 Claims, 2 Drawing Sheets

METHOD FOR CONTROLLING A HYDRAULIC ROTARY AND FEED DRIVE FOR A COLD PILGER ROLLING MILL

BACKGROUND OF THE INVENTION

1. Field of the Invention

The invention relates to a method for controlling a hydraulic rotary and feed drive for rotating and feeding tubes in a cold pilger rolling mill for producing tubes in which a rolling stand of the cold pilger rolling mill moves back and forth in the rolling direction via a crank drive, the rolls of the rolling stand being of a tapered design and rolling over the rolling stock with an alternating sense of rotation as the rolling stand moves back and forth, the rolling stand occasionally releasing the tube so that the tube can be rotated and fed to a new position by the hydraulic rotary and feed drive as a function of the position of the crankshaft of the rolling stand, and the rotation and feeding of the tube being performed by hydraulic motors controlled by a pressure medium and assigned to the rotary and feed drive members acting on the tube.

2. Description of the Related Art

In the 1960s, movements of rotary and feed drives for a tube during the execution of a cold pilger rolling method were represented hydromechanically. That is, cam plates were used to move control pistons of the valves of hydraulic motors. This mechanically complicated type of valve drive led to frequent failures. Furthermore, frequent pipe line breakages occurred because of very hard braking ramps.

In the cold pilger rolling mills of the 1990s, a very complicated servo-hydraulic path control has been used to track the rotary and feed movement otherwise produced purely mechanically with cam plate drives. This system operates reliably but has disadvantages with regard to production costs and maintenance. For example, the servo valves used in these systems are specialized products and therefore have long delivery times. Accordingly, when one of these valves becomes inoperable and requires replacement in the case of damage, the cold pilger rolling mill is inoperable or at least not optimally operable until the new valve can be delivered. To alleviate this concern, the servo valves may be stored as spare parts. However, the servo valves require regular cleaning of preservatives and renewing of the preservatives to maintain operability. Accordingly, a high maintenance cost is associated with storing the valves.

In addition, the complicated control path of these drives has the effect that it is difficult to locate faults when they occur. Well trained experts who can clarify whether there is a malfunction in the servo hydraulics, in the control or in the mechanism are required to trouble shoot the faults. Such highly qualified personnel are not available in many mills and must be summoned from, for example, a regional service center.

SUMMARY OF THE INVENTION

It is the object of the present invention to provide a method for controlling a rotary and feed drive for a cold pilger rolling mill that is reliable, maintenance-friendly and cost-effective.

To achieve the object, it is proposed according to the invention that a control method according to an embodiment of the invention includes controlling a pressure medium feed for each hydraulic motor in a rotary and feed drive for a cold pilger rolling mill by a proportional valve which is opened for a time interval proportional to a length of a path required for the drive member to be moved by the hydraulic motor.

The control according to the invention is performed using a logic which is easy to understand and implemented with simple components. The complicated path control of the prior art is replaced by stipulating a time interval during which a control valve must remain open to effect a corresponding amount of movement. This system is a cost-effective solution for the existing problem in that there is a low maintenance outlay and no exceptional maintenance staff demands are required.

In a refined embodiment of the invention, the movement executed by each drive member or hydraulic motor is measured and compared with a stored desired value. The time intervals for the valve opening are then corrected in response to any deviation determined between the measured and the desired values.

The reliability and accuracy achievable by the control system according to the present invention allow the simple control system to operate a cold pilger rolling mill of the generic type. The cold pilger rolling mill may be operated with a simple control loop, without the demanding control requirement of the prior art systems. In addition, faults in the system are easily located because the previously complicated path control of the servo valves is eliminated.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
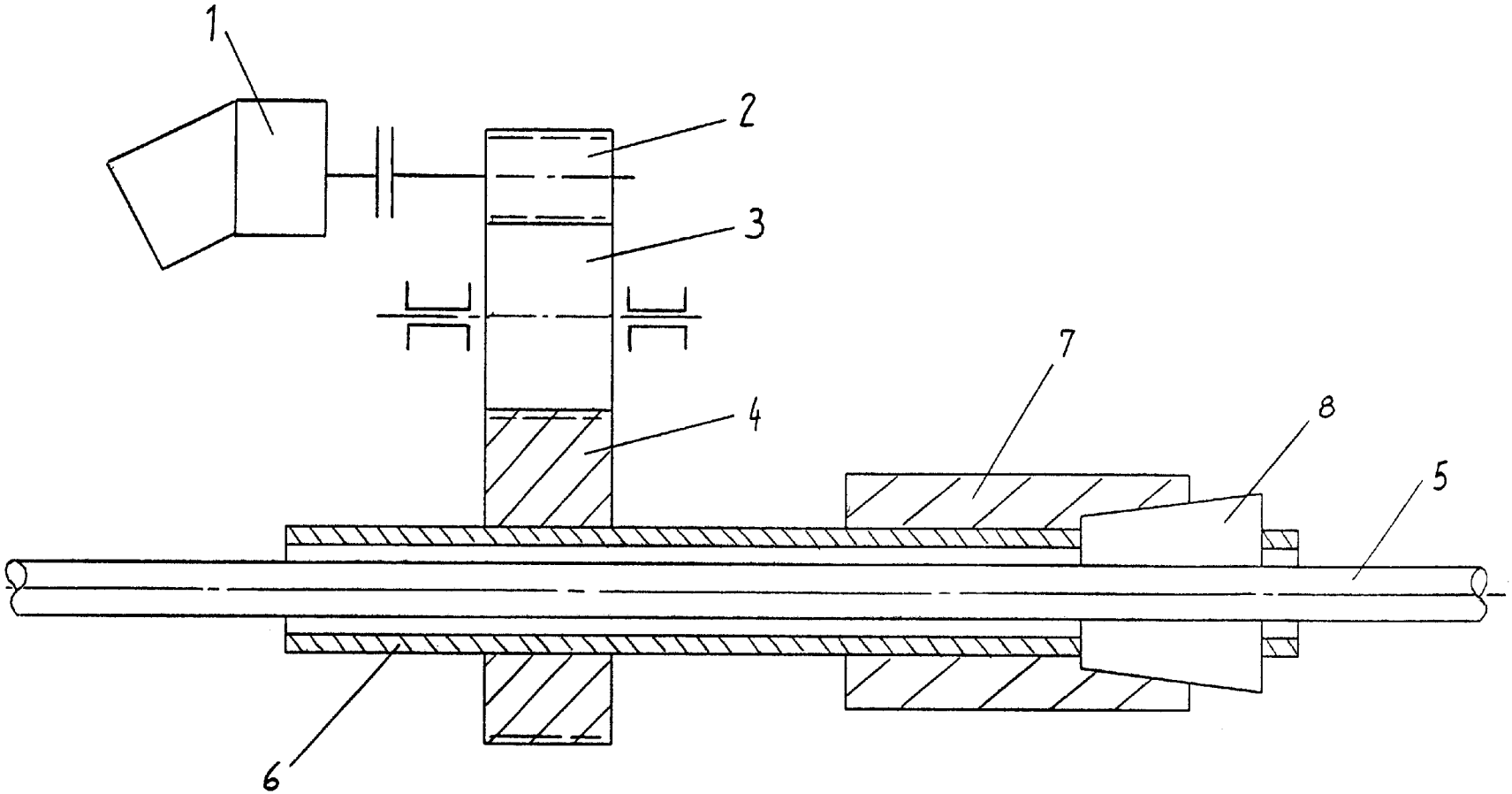
FIG. 1 is a longitudinal sectional view of a rotary and feed drive for a tube for use in a cold pilger rolling mill.

FIG. 1 depicts a rotary and feed drive 10 for a cold pilger rolling mill. A hydraulic motor 1 is schematically depicted which rotatably drives a sleeve 6 via spur gear sets 2, 3, 4. The sleeve 6 embraces a tube 5 to be rotated and fed by the rotary and feed drive 10. The sleeve 6 is connected to a jaw chuck 7 that is equipped with clamping jaws 8 which are applicable to the outer surface of the tube 5 for clamping the tube 5. When the tube 5 is clamped via the clamping jaws 8, actuation of the hydraulic motor 1 creates a roll torque initiated by the gear set 2 to 4 that is transmitted to the tube 5.

Figure 2:
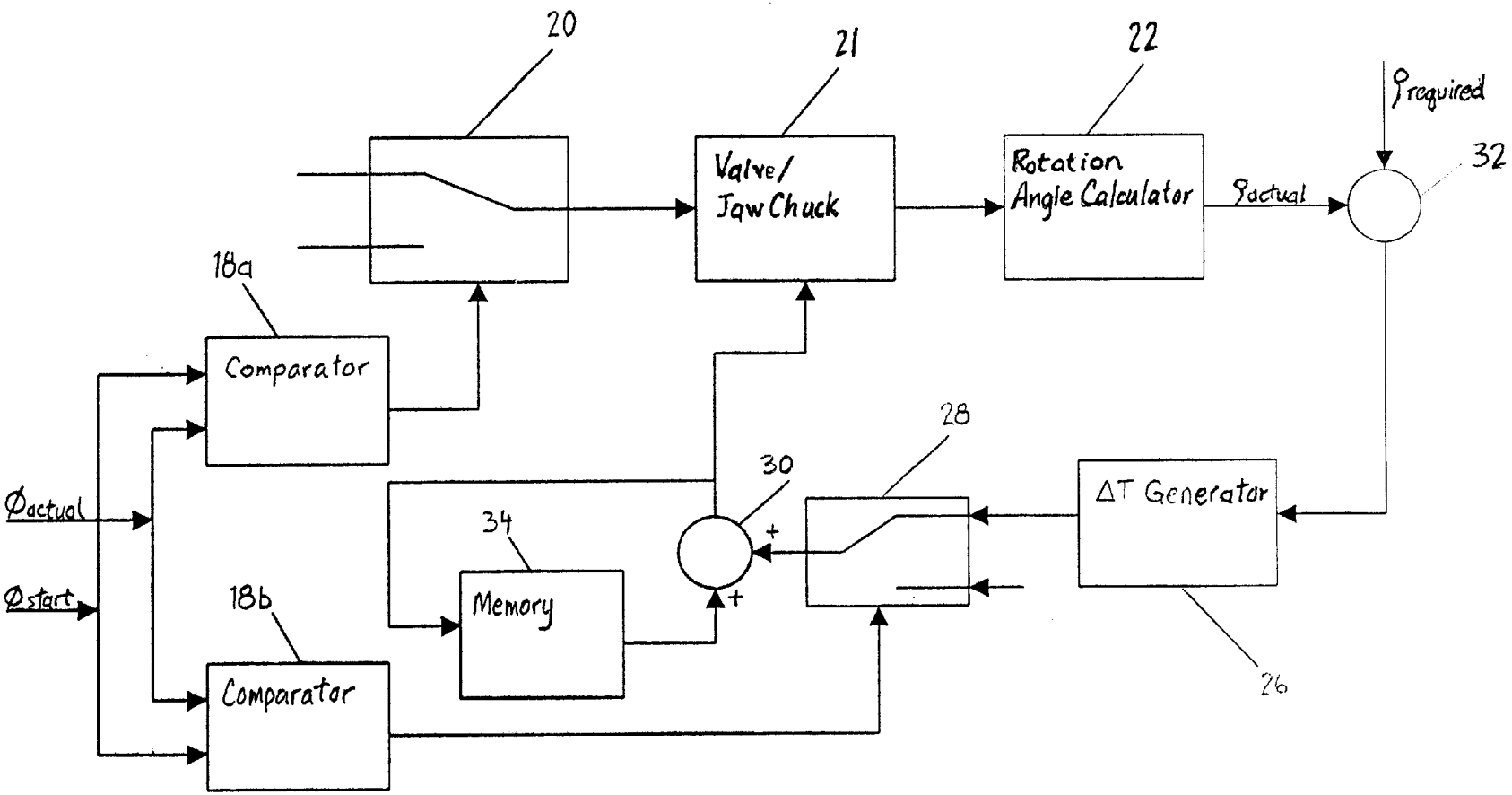
FIG. 2 is a control diagram of a control method according to an embodiment of the present invention for controlling the rotary and feed drive of FIG. 1.

The control method according to an embodiment of the present invention is represented in the control diagram of FIG. 2. At the start of the control method, the tube 5 is released by the roll stand of the cold pilger rolling stand so that the tube can be rotated and fed to a new position by the hydraulic rotary and feed drive of FIG. 1. Upon release of the tube by the rolling stand, the actual crank position $\phi_{ACT}$ is measured at the crankshaft of the rolling stand of the cold pilger rolling mill. A starting value $\phi_{start}$ for the crank position relative to the new position to which the tube is to be fed is stipulated externally. Signals representing the actual crank position $\phi_{act}$ and the starting value $\phi_{start}$ are transmitted to comparators 18*a*, 18*b*. If the actual crank position $\phi_{act}$ is greater than the starting value $\phi_{start}$, the comparator 18*a* transmits a signal to a proportional valve 20 for opening a proportional valve. The opening of the proportional valve actuates the hydraulic motor 1 which rotates the jaw chuck 7, as described above, which are represented by block 21. At the same time a memory 34 transmits a time T to hold the porportional valve open and operate the hydraulic motor and jaw chuck 21. The time T is predetermined amount of time required to make up the difference between the actual crank angle $\phi_{act}$ and the starting value $\phi_{start}$. The jaw chuck rotates at a rotational speed ρ which is transmitted to a rotation angle calculator 22. An actual angle of rotation $\rho_{act}$ effected by the rotation of the jaw chuck during the time interval T is then calculated at the angle of rotation calculator 22. The calculated actual angle of rotation $\rho_{act}$ is subtracted from a desired angle of rotation $\rho_{des}$ at adder 32. The desired angle of rotation $\rho_{des}$ is the angle of rotation required to effect the positioning of the tube to the starting value $\phi_{start}$. A difference between the actual angle of rotation $\rho_{act}$ and the desired angle of rotation $\rho_{des}$ is transmitted from the adder 32 to a ΔT generator 26 which calculates a correction value ΔT. The proportional valve remains open in a fashion proportional to the difference between the desired angle of rotation $\rho_{des}$ and the actual angle of rotation $\rho_{act}$ until $\phi_{act}=\phi_{start}$,.

When $\phi_{act}=\phi_{start}$, the comparator 18*b* transmits a signal to a switch 28 and the correction value ΔT generated at the ΔT generator 26 is routed to an adder 30 via a switch 28 for updating the value T stored in the memory 34 by the correction value ΔT to correct the difference between the desired angle of rotation $\rho_{des}$ and the actual angle of rotation $\rho_{act}$. Accordingly, the next time the rolling stand releases the tube for repositioning, the proportional valve will be held open for a time of the updated value T in memory 34.

The invention is not limited by the embodiments described above which are presented as examples only but can be modified in various ways within the scope of protection defined by the appended patent claims.

We claim:

1. A method of controlling a hydraulic rotary and feed drive for rotating and feeding a rolling stock in a cold pilger rolling mill that produces the rolling stock, the cold pilger rolling mill having a rolling stand which moves back and forth in the rolling direction via a crank drive with a crank shaft, the rolls of the rolling stand being of a tapered design and rolling over a portion of the rolling stock with an alternating sense of rotation as the rolling stand moves back and forth, the roll stand intermittently releasing the rolling stock for rotating and feeding the rolling stock to a new position via the hydraulic rotary and feed drive as a function of the position of the crankshaft of the rolling stand, the rotary and feed drive having hydraulic motors which are actuated by a pressure medium for rotating and feeding the rolling stock and assigned to drive members acting on the tube, the method comprising the steps of:

retrieving a stored time interval from a memory, the stored time interval corresponding to an actuation time required for rotating and feeding the rolling stock to the new position;

controlling a feed of the pressure medium to the hydraulic motors of the hydraulic rotary and feed drive by opening a proportional valve for the stored time interval and thereby actuating the hydraulic motors for rotating and feeding the rolling stock to the new position; and measuring the actual movement effected by actuation of the hydraulic motors and comparing the measured actual movement with a stored desired value and determining differences therebetween, and determining a change in the stored time interval required to correct the differences between the measured actual movement and the stored desired value.

2. The method for controlling a hydraulic rotary and feed drive of claim 1, further comprising the step of correcting the stored time interval in response to the determined differences.

* * * * *